United States Patent [19]

Duckworth et al.

[11] Patent Number: 4,507,177

[45] Date of Patent: Mar. 26, 1985

[54] METHOD OF STABILIZATION OF PARTICULATE MATERIAL

[75] Inventors: Roger Duckworth, Guildford; Roy A. Johnson, Worplesdon; Timothy E. Lester, Hampton, all of England

[73] Assignee: The British Petroleum Company p.l.c., London, England

[21] Appl. No.: 543,892

[22] Filed: Oct. 20, 1983

[30] Foreign Application Priority Data

Oct. 29, 1982 [GB] United Kingdom ..... 8230984

[51] Int. Cl.[3] ..... C25B 1/00; C25D 9/08

[52] U.S. Cl. ..... 204/1 R; 204/16; 204/56 R

[58] Field of Search ..... 204/1 R, 16, 22, 56 R, 204/24, 23

[56] References Cited

U.S. PATENT DOCUMENTS

| | | | |
|---|---|---|---|
| 1,753,721 | 4/1930 | Robinson | 204/22 |
| 1,794,449 | 3/1931 | Drake | 204/22 |
| 2,200,469 | 5/1940 | Cox | 204/26 |
| 2,687,993 | 8/1954 | Cox | 204/145 R |
| 3,046,204 | 7/1962 | Barron | 204/16 |
| 3,396,057 | 8/1968 | Webb | 204/16 |
| 4,246,075 | 1/1981 | Hilbertz | 204/1 R |

*Primary Examiner*—Thomas Tufariello

*Attorney, Agent, or Firm*—Morgan, Finnegan, Pine, Foley & Lee

[57] ABSTRACT

A method of stabilizing particulate material covered by a liquid electrolyte containing dissolved inorganic salts in which a cathode is placed below the surface of the particulate material and an anode is placed in the liquid electrolyte or in the particulate material so that it is in an electrical relationship with the cathode. An electrical current is then passed betweeen the electrodes for a sufficient time to cause the dissolved inorganic salts to deposit on or between the cathode and the interface of the particulate material and liquid electrolyte.

14 Claims, 4 Drawing Figures

METHOD OF STABILIZATION OF PARTICULATE MATERIAL

The present invention relates to the stabilisation of particulate material by the electrically induced deposition of dissolved salts from aqueous media.

U.S. Pat. No. 4,246,075 discloses that passing a direct electrical current between electrodes in an electrolyte like sea water tends to cause precipitation or deposition of minerals at the cathode. By use of a large surface area pre-formed cathode such as a mesh construction and passing the electrical current for a sufficient length of time, a solid covering can accrete on the cathode which it is claimed can yield building components of significant structural strength such as pipelines, bridges, sea walls etc.

The present invention uses the deposition of dissolved salts from aqueous media to obtain stabilisation of particulate material such as that forming a beach or an artificial island against, for example, its erosion or dispersion by wind or wave action.

Thus according to the present invention there is provided a method of stabilising particulate material covered by a liquid electrolyte containing one or more dissolved salts comprising (a) placing a first electrode below the surface of the particulate material, (b) placing a second electrode in the liquid electrolyte or in the particulate material so that it is in an electrical relationship with the cathode and (c) passing an electrical current between the electrodes for a sufficient time to cause the dissolved salts to deposit on or between the first electrode and the interface of the particulate material and liquid electrolyte.

Preferably direct current is used although it is envisaged that an alternating current or a direct current having an alternating component may be used. In the case of direct current, the cathode material may be of any suitable material which is preferably resistant to corrosion. Galvanised material, steel, or conductive plastics or composite materials may be used. The cathodes may be in the form of wire, grids or meshes, plates or spirals. The mesh is preferably formed from galvanised iron, carbon fibre, conducting mesh or a conductive glass or carbon fibre/resin composite material. The cathode may be in the form of an L-shaped grid, one leg of which lies beneath the particulate material or in the form of a flat plate or mesh wholly beneath the particulate material. It appears that the depth of the cathode below the surface of the particulate material for a suitable accretion rate is dependent upon its permeability. Thus for large particulate size material a faster rate of accretion would be expected than for small particulate size material for similar types of packing. The anodic material is preferably made of carbon e.g. graphite and preferably are spaced up to distances of 50 meters from the cathode. The direct electric current may be a continuous or pulsed direct current.

The particulate material is preferably a solid such as silt, sand, shingle or pebbles. The particle size of the solids may vary widely. The position of the deposited salts depends upon the packing density of the particulate material. For example, in the case of a fine sand particulate material, the deposit tends to take the form of a shell at the interface of the electrolyte and the particulate material. In the case of a coarse particle such as shingle the deposit tends to take place in the interior of the particle material or around the cathode. In the case of a cathode say in the form of a grid having a layer of pebbles on top, the deposition of dissolved salts can enable an aggregate solid of substantial rigidity to be formed.

The liquid electrolyte containing one or more dissolved salts is preferably an aqueous medium containing dissolved inorganic salts most preferably being naturally occurring water having a high dissolved salts content for example sea water, brackish water, river water. It is envisaged that a suitable electrolyte may also be achieved by addition of soluble chemicals to an aqueous media. The salts content should be sufficient to enable a degree of accretion to occur within a practical time scale of operation. The optimum rate of movement of the electrolyte in the region of the cathode should be sufficient to transport dissolved salts to the cathode site but to allow sufficient time to cause accretion to occur. The electrolyte may be artificially agitated for example by stirring or pumping or may be simply subjected to natural electrolyte movements or other forms of electrolyte movements e.g. those caused by convection. It is believed that the deposition of dissolved material is influenced by the local pH of the electrolyte.

The invention may be useful in a number of applications. Thus by depositing a rigid shell on the sea or river estuary bed, erosion of the bed by tides and currents may be influenced, reduced or prevented. Also by deposition within the particulate material man made sand islands and dykes may be protected and pumped sand civil works may be consolidated and by strategic placement of cathodes, directional water flows and debris drop out may be influenced. Further the technique has the advantage that it can be used to renew or repair breaches in the rigid deposit. Also the technique may possibly be used for producing barriers at the sea shore or river estuary (for example) to prevent the incursion of sea water or brackish water into sweet or fresh water reserves, aquifers, reservoirs etc.

A specific application of the invention is envisaged as follows. The erosion of loosely compacted soils by currents and waves at sea may be resisted by formation of thin shells of rigid, low permeability structures formed in situ by the electrical deposition of minerals from surrounding sea water. For large scale construction of artificial sand islands, sand aggregate materials may be pumped or dredged to form the base of an island below the water level using conventional techniques. If stabilisation of the particulate material is achieved according to the invention, the slope angle of the aggregate materials may be greater than that used for conventional islands having no protective outer layer or binding in the body of the aggregate thereby requiring the use and transport of less aggregate. Conducting cables or coarse wire meshes may be laid below the sand or aggregate surface and an electrical current supply supplied between these wires, which act as cathodes, and one or more anodes located in the water around the structure. Further sand or other aggregate material may be continually added so as to be bound to the surface by a growing layer of precipitated minerals. A single layer of sand over the cathode enables a single outer shell layer to be formed but subsequent layers may be added to increase resistance to erosion. The power supply to the electrodes may be maintained at a low level to allow the surface shell to be increased or consolidated material to be strengthened by incorporating sediments normally found in sea water.

The invention will now be described by way of example only and with reference to the accompanying drawings.

Figure 1:
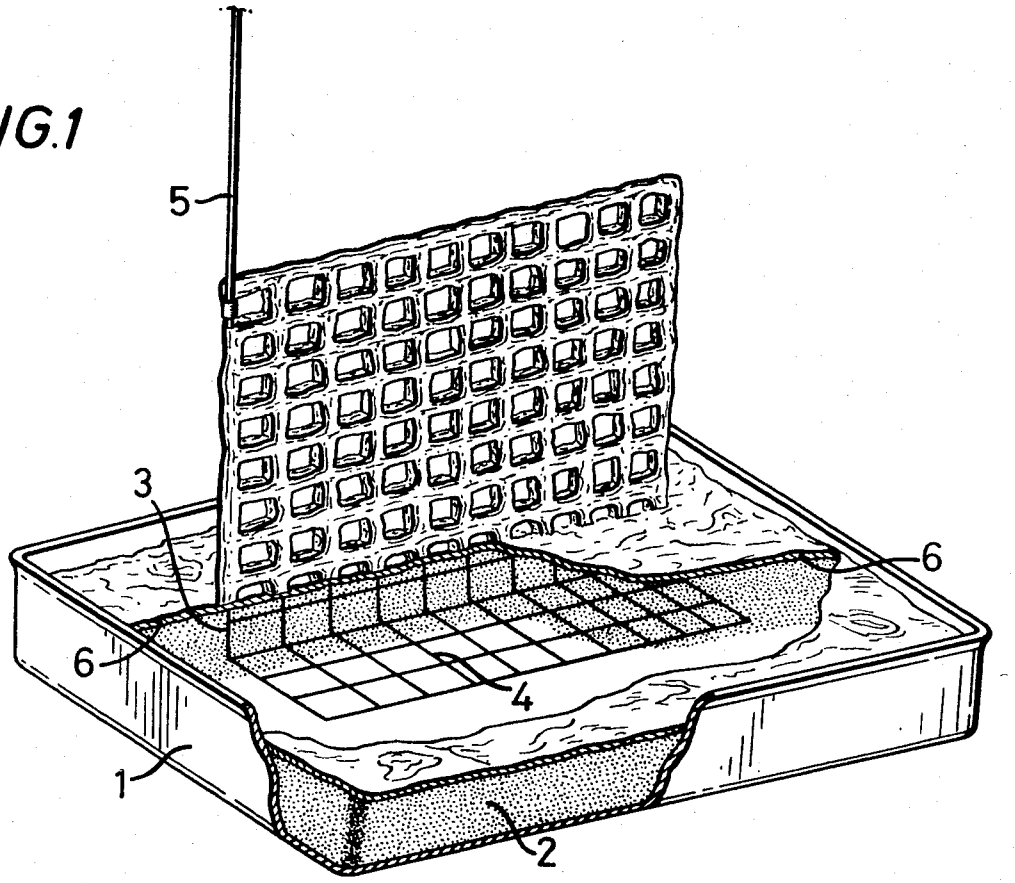
FIG. 1 shows a schematic diagram of a tray containing sand which partly covers an L-shaped cathode, the tray being suitable for immersion in sea water.

In the arrangement shown in FIG. 1, a shallow tray 1 is filled with particulate sand 2. An L-shaped metal grid 3 acting as a cathode has its base portion 4 covered by the particulate sand 2. The grid 3 is connected by a metal wire 5 to an external generator (not shown) capable of supplying current. The tray 1 and grid 3 are totally submerged in sea water and a carbon anode (not shown) is located nearby.

During use, a direct current of one amp was supplied from the external generator to the grid 3 for twenty days. Slow deposition of minerals was found on the upper portion of the L-shaped grid which was in direct contact with the sea water. For the portion 4 of the grid cathode below the surface of the particulate sand no deposition was observed. However, it was noted that a thin rigid shell 6 had formed on the upper surface of the particulate sand 2 at the interface between the sand and sea water. This shell 6 appeared to be rigid and of low permeability and was apparently formed from deposited minerals or a mix of sand and deposited minerals.

Figure 2:
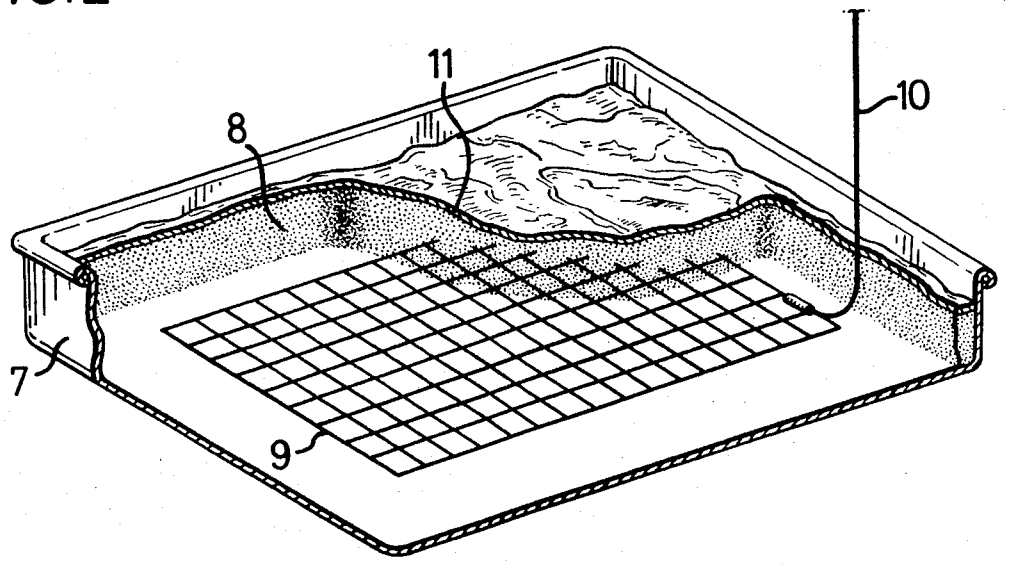
FIG. 2 shows a schematic diagram of a tray containing a flat grid cathode wholly covered by sand, the tray being suitable for immersion in sea water.

In the arrangement shown in FIG. 2, a shallow tray 7 is filled with particulate sand 8. A flat metal grid shaped cathode 9 is completely covered by the particulate sand 8. The grid cathode 9 is connected by a metal wire 10 to an external generator (not shown) capable of supplying current. The tray 7 is totally submerged in sea water and a cathode anode (not shown) is located nearby.

During use a direct current of one amp was supplied from the external generator to the grid 9 for a period of twenty days. No deposition of minerals was observed on the grid cathode 9 but it was noted that a thin rigid shell 11 apparently of minerals or a mix of sand and minerals had formed on the upper surface of the particulate sand.

Details of the tests are shown in the following table.

TABLE

| | |
|---|---|
| Grid cathode | Metal mesh welded in squares |
| Grid size | L-shaped grid 12 in × 10 in × 4 in base portion<br>Flat grid 12 in × 11 in |
| Grid mesh size | 1 in × 1 in with ⅛ diameter wire |
| Grid depth | 1 inch below surface of particulate sand |
| Particulate solid | Builders soft sand |
| Tray (plastics material) | 13 in × 9 in × 2 in deep |
| Tray (wood) | 14 in × 12 in × 2 in deep |
| Voltage | Varied between 4 and 6 volts |
| Current | 1 ampere |
| Duration of test | 20 days |

Figure 3:
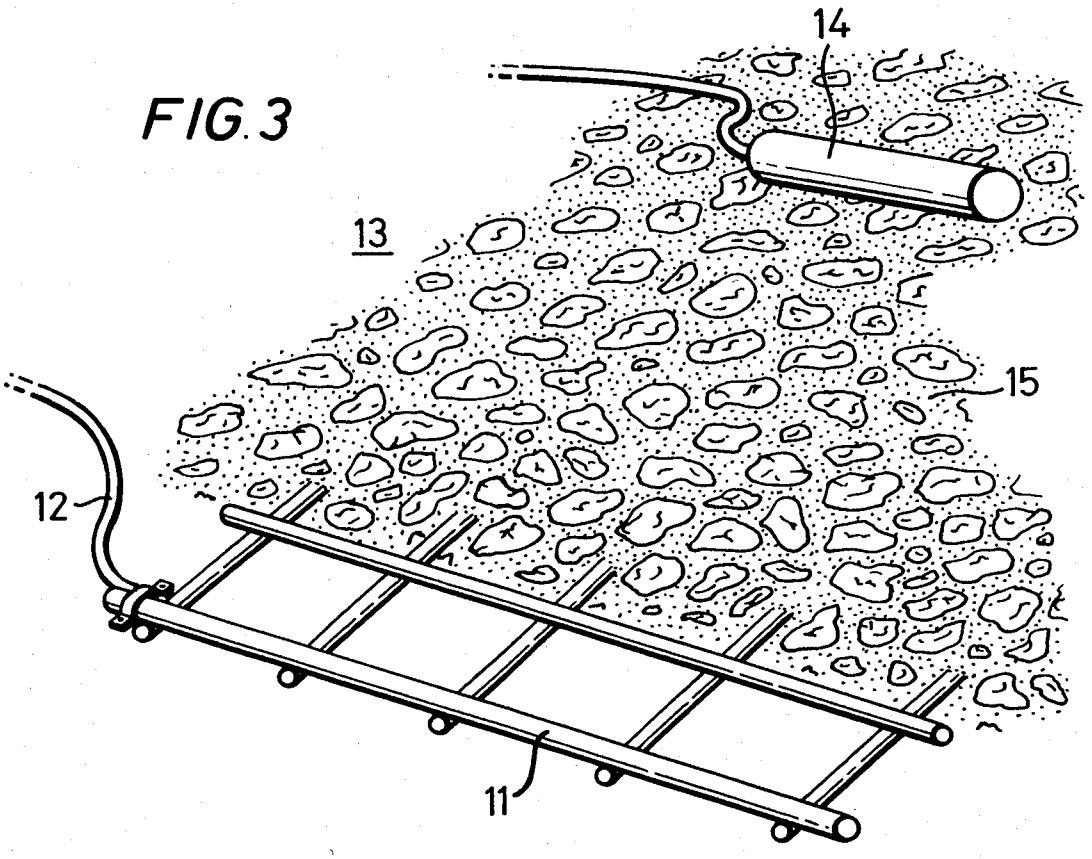
FIG. 3 shows a schematic diagram of a mesh cathode lying beneath a coarse aggregate material with an anode located nearby.

FIG. 3 is illustrative of a further experiment, in which a cathode, in the form of a horizontal mild steel grid of wire diameter 3 mm forming 25 mm side squares is covered with beach gravel with stone sizes ranging from fine sand to stones of 40 mm dimension, the gravel being held in a plastic tray having perforated sides. The tray was in a position relative to the surface so that the gravel passed through the water surface to form a sloping beach. Sea water was pumped over this simulated beach surface at a rate of about 2 gallons/minute. The grid cathode 11 is connected by a metal wire 12 to a current supply and the whole was submerged in sea water 13 with a nearby carbon anode 14, the anode 14 being positioned in the sea water or beneath the surface of the aggregate 15. The carbon anode was in the form of a graphite rod of 75 mm diameter and 300 mm long and was freely suspended in the sea water at a distance of 600 mm from the cathode. After a direct current of 0.5 amp for a voltage drop of 5 volts between electrodes had been supplied for a period of 30 days, it was observed that an aggregate of pebbles and precipitated material from the sea water, the aggregate being of substantial strength, was formed on or around the cathode 11.

Fine silts and mud which have low permeability when allowed to settle and compact tend to prevent the growth of an accretion protective skin when the thickness of such material covering the electrode exceeds 200 mm. Large pebbles of average diameter 50 mm may cover the cathode to a depth of 2 meters before the accretion binding effect is substantially reduced.

The present experiments have been carried out with dissolved solid content 30 to 35 parts by weight per 1000 parts by weight of sea water. Electrolyte of dissolved solids content below or above these values are expected to reduce or increase the maximum cathode coverage depth accordingly.

Figure 4:
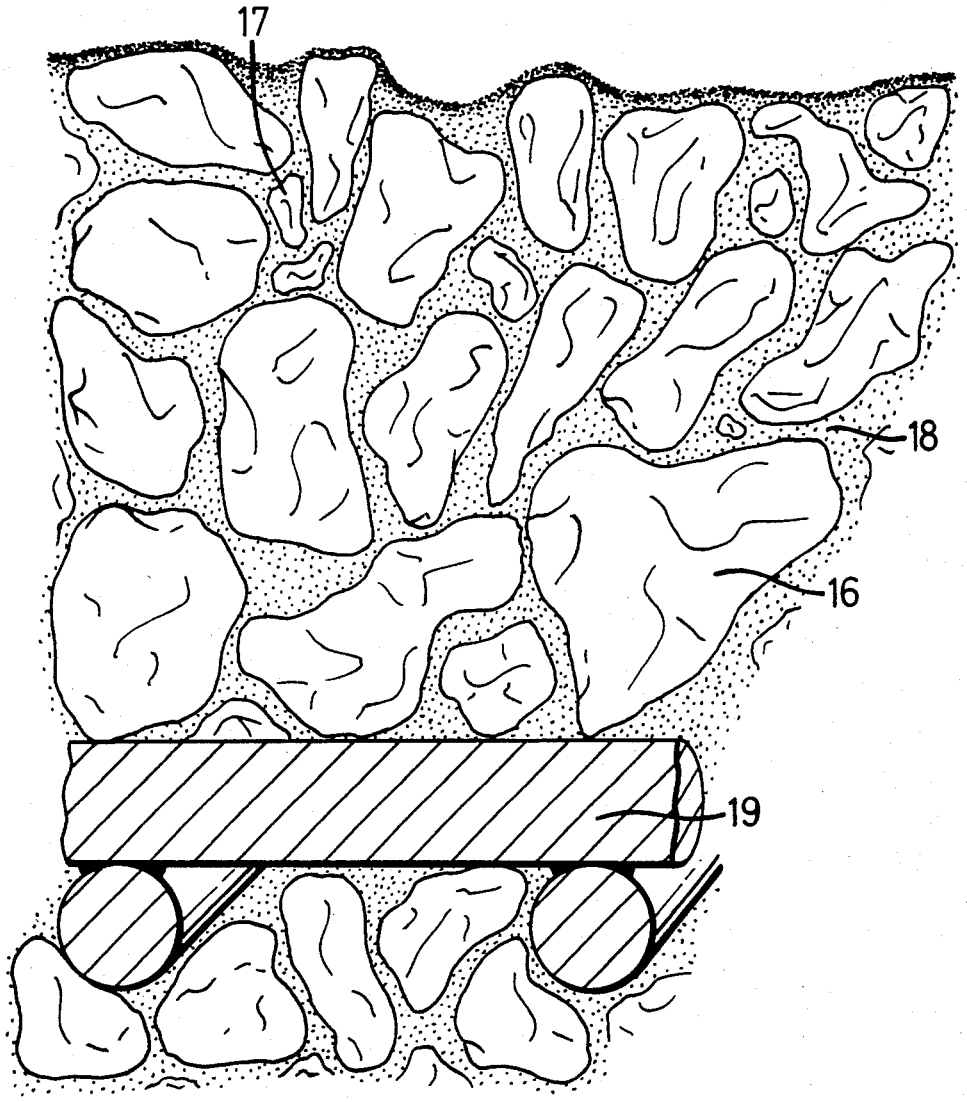
FIG. 4 is a schematic vertical cross section showing the binding action of marine accretion on a coarse aggregate subsequent to a period of electrical deposition.

FIG. 4 shows the binding action of the accreted material for example, beneath the sea bed or on the slope of an artificial island. Thus, large pebbles 16 (say of diameter greater than 10 mm) are bound together where they are in close proximity. Smaller stones or pebbles 17 are completely enveloped by the accretion which will also bind in naturally occurring or added sand and silt 18 during the accretion process. Interstitial spaces become totally or almost totally blocked as the accretion proceeds. Electrical power consumption tends to fall during the accretion process and current flow can be maintained or increased by increasing the voltage between the anode (not shown) and cathode 19 if required.

The maximum depth of immersion of the cathode depends on the pebble size but is typically 0.5 meters for pebbles of about 20 mm diameter.

For certain operating conditions it appears desirable to operate the current flow intermittently e.g. in cycles of 30 minutes on, 30 minutes off to enable gas bubbles to disperse and the accreted material to consolidate.

For the protection and strengthening of saturated timber beneath electrolyte solutions e.g. sea water, cathode wires or straps are fitted to the timbers at intervals of, e.g., 0.3 meters and a current passed. Where it is practicable to drill the timber it is preferable to insert the cathode into the timber at a depth dependent on the permeability of the timber but typically up to 100 mm from the timber/electrolyte interface.

We claim:

1. A method of stabilizing particulate material located beneath naturally occurring water comprising the steps of (a) placing a first electrode below the surface of the particulate material, (b) positioning a second electrode in electrical relationship with the first electrode and (c) passing an electrical current between the electrodes for a sufficient time to cause dissolved salts in the water to deposit on or between the first electrode and the interface of the particulate material and the water.

2. A method according to claim 1 in which the particulate material is silt, sand, shingle or pebbles.

3. A method according to claim 1 in which the dissolved salt is an inorganic salt.

4. A method according to claim 3 in which the one or more dissolved inorganic salts comprise one or more of the salts of magnesium, calcium, potassium and sodium.

5. A method according to claim 1 in which the particulate material is sufficiently tightly packed to cause the dissolved inorganic salts to deposit and form a shell at the electrolyte/particulate material interface.

6. A method according to claim 1 in which the particulate material is loosely packed to cause the dissolved inorganic salts to deposit on or adjacent to the cathode.

7. A method according to claim 6 in which the cathode is in the form of a grid or mesh associated with a layer of pebbles or stones, the inorganic salts being deposited on the pebbles and cathode to form an aggregate of substantial rigidity.

8. A method according to claim 1 in which the electrical current is a direct current.

9. A method according to claim 8 in which the direct current is a pulsed direct current.

10. A method according to claim 6 in which the cathode is a wire, mesh, plate or spiral.

11. A method according to claim 9 in which the cathode is fabricated from a metal or an electrically conducting composite material.

12. A method according to claim 1 in which the anodic material is carbon.

13. A method according to claim 1 in which the electrolyte is mechanically agitated.

14. Particulate material whenever stabilised according to a method according to claim 1.

* * * * *